US011521809B2

(12) United States Patent
Wu

(10) Patent No.: US 11,521,809 B2
(45) Date of Patent: Dec. 6, 2022

(54) KEY STRUCTURE AND ASSEMBLY METHOD THEREOF

(71) Applicant: Silitek Electronics (Dongguan) Co., Ltd, Guangdong (CN)

(72) Inventor: George Wu, Guangdong (CN)

(73) Assignee: SILITEK ELECTRONICS (DONGGUAN) CO., LTD, Guangdong (CN)

( * ) Notice: Subject to any disclaimer, the term of this patent is extended or adjusted under 35 U.S.C. 154(b) by 627 days.

(21) Appl. No.: 16/566,401

(22) Filed: Sep. 10, 2019

(65) Prior Publication Data

US 2020/0126737 A1 Apr. 23, 2020

(30) Foreign Application Priority Data

Oct. 19, 2018 (CN) ..... 201811223249.3

(51) Int. Cl.
*H01H 13/14* (2006.01)
*H01H 13/52* (2006.01)
*G05G 1/02* (2006.01)

(52) U.S. Cl.
CPC ..... *H01H 13/14* (2013.01); *G05G 1/02* (2013.01); *H01H 13/52* (2013.01);
(Continued)

(58) Field of Classification Search
CPC .. H01H 3/122; H01H 13/52; H01H 2229/066; H01H 13/14; H01H 2223/03;
(Continued)

(56) References Cited

U.S. PATENT DOCUMENTS 9,972,455 B2 * 5/2018 Ren ..... H01H 3/32
10,224,159 B2 * 3/2019 Shen ..... H01H 3/122
(Continued)

FOREIGN PATENT DOCUMENTS

CN 203607300 U 5/2014
CN 106158481 A 11/2016
(Continued)

OTHER PUBLICATIONS

TIPO Office Action dated Feb. 18, 2019, Application No. 107139353, pp. 1-6.

*Primary Examiner* — Edwin A. Leon
(74) *Attorney, Agent, or Firm* — McClure, Qualey & Rodack, LLP

(57) ABSTRACT

A key structure and an assembly method thereof are provided. The key structure includes a base plate, a switch, two fixing bases, two movable members and a keycap. The base plate includes upper and bottom surfaces, and has a first accommodation hole and two second accommodation holes. The switch is disposed on the base plate through the first accommodation hole. The two fixing bases are disposed on the base plate respectively through the two second accommodation holes. Each fixing base has a guiding channel. The two movable members are disposed in the two guiding channels. The keycap is disposed on the switch and the two movable members. Each fixing base includes a first portion protruded from the upper surface and a second portion protruded from the bottom surface. The vertical projection area of the first portion is not greater than the vertical projection area of the second portion.

14 Claims, 12 Drawing Sheets

(52) U.S. Cl.
CPC . *H01H 2221/026* (2013.01); *H01H 2229/066* (2013.01); *H01H 2233/07* (2013.01)

(58) Field of Classification Search
CPC . H01H 2221/026; H01H 2233/07; G05G 1/02
See application file for complete search history.

(56) References Cited

U.S. PATENT DOCUMENTS

| | | | |
|---|---|---|---|
| 2006/0076222 | A1 | 4/2006 | Lin et al. |
| 2006/0132447 | A1 | 6/2006 | Conrad |

FOREIGN PATENT DOCUMENTS

| | | | |
|---|---|---|---|
| CN | 106783319 | A | 5/2017 |
| TW | M268664 | U | 6/2005 |

* cited by examiner

KEY STRUCTURE AND ASSEMBLY METHOD THEREOF

This application claims the benefit of People's Republic of China Application No. 201811223249.3, filed Oct. 19, 2018, the disclosure of which is incorporated by reference herein in its entirety.

BACKGROUND OF THE INVENTION

Field of the Invention

The invention relates in general to a key structure and an assembly method thereof, and more particularly to a mechanical key structure with hand pressing feeling and an assembly method thereof.

Description of the Related Art

Input device is normally used as a communication interface between the user and the electronic device. The input device, such as a plurality of key structures. By pressing different keys, the user can enable the electronic device to generate corresponding actions. Of the different types of key structure, the mechanical key structure possessing the advantages of better hand touch, longer lifespan and shorter triggering course has won a great popularity over the years.

The current trend of the mechanical key structure is also directed towards thinness, and the keycap skirt is shorter. However, the shorter the keycap skirt, the easier the internal structure will become visible to the user. Particularly, the structure under the base plate will become visible to the user and the aesthetics of the external appearance will be greatly jeopardized.

Therefore, it has become a prominent task for the industries to provide a new key structure and a new assembly method thereof to resolve the above problem.

SUMMARY OF THE INVENTION

The invention is directed to a key structure and an assembly method thereof capable of decreasing the probability of the structure under the base plate becoming visible to the user.

According to one embodiment of the present invention, a key structure is provided. The key structure includes a base plate, a switch, two fixing bases, two movable members and a keycap. The base plate includes an upper surface and a bottom surface, and has a first accommodation hole and two second accommodation holes penetrating through the upper surface and the bottom surface. The switch is disposed on the base plate and passes through the first accommodation hole. The two fixing bases respectively are disposed on the base plate and pass through the two second accommodation holes, wherein each of the two fixing bases has a guiding channel. The two movable members are disposed in the two guiding channels. The keycap is disposed on the switch and the two movable members. Each fixing base includes a first portion protruded from the upper surface and a second portion protruded from the bottom surface. The projection area of the first portion in a direction perpendicular to the upper surface is not greater than the projection area of the second portion in a direction perpendicular to the bottom surface.

According to another embodiment of the present invention, an assembly method of a key structure is provided. The assembly method includes the following steps. Two fixing bases and two movable members are provided, wherein each of the two fixing bases has a guiding channel. Two movable members are respectively placed in the two guiding channels from the bottom of the two fixing bases. A base plate is provided, wherein the base plate includes an upper surface and a bottom surface, and has a first accommodation hole and two second accommodation holes penetrating through the upper surface and the bottom surface. The two fixing bases are respectively disposed on the base plate and pass through the two second accommodation holes from the bottom surface. A switch disposed on the base plate and passing through the first accommodation hole is provided. A keycap disposed on the switch and two movable members is provided.

The above and other aspects of the invention will become better understood with regard to the following detailed description of the preferred but non-limiting embodiment (s). The following description is made with reference to the accompanying drawings.

DETAILED DESCRIPTION OF THE INVENTION

The present invention relates to a key structure and an assembly method thereof. In some embodiments, the fixing base includes a first portion and a second portion. The first portion is protruded from the upper surface of the base plate, and the second portion is protruded from the bottom surface of the base plate. The projection area of the first portion in a direction perpendicular to the upper surface of the base plate is not greater than the projection area of the second portion in a direction perpendicular to the bottom surface of the base plate. The fixing base is disposed on the base plate by passing through the bottom surface thereof. Through such arrangement, the hole on the base plate does not need to be large and long. The size and shape of the hole only need to match that of the fixing base. Thus, the structure under the base plate is less likely to be seen.

It should be noted that although the present disclosure does not illustrate all possible embodiments, other embodiments not disclosed in the present disclosure are still applicable. Moreover, the dimension scales used in the accompanying drawings are not based on actual proportion of the product. Therefore, the specification and drawings are for explaining and describing the embodiment only, not for limiting the scope of protection of the present disclosure. Furthermore, descriptions of the embodiments, such as detailed structures, manufacturing procedures and materials, are for exemplification purpose only, not for limiting the scope of protection of the present disclosure. Suitable modifications or changes can be made to the structures and procedures of the embodiments to meet actual needs without breaching the spirit of the present disclosure. Designations common to the accompanying drawings are used to indicate identical or similar elements.

In the present specification, terminologies such as "the upper surface", "the bottom surface", "the bottom" and "the top" are used to describe relative position of an element of a device at its natural state of application. Thus, even when the device illustrated in an accompanying drawing is turned over, the said relative position remains unchanged.

Figure 1:
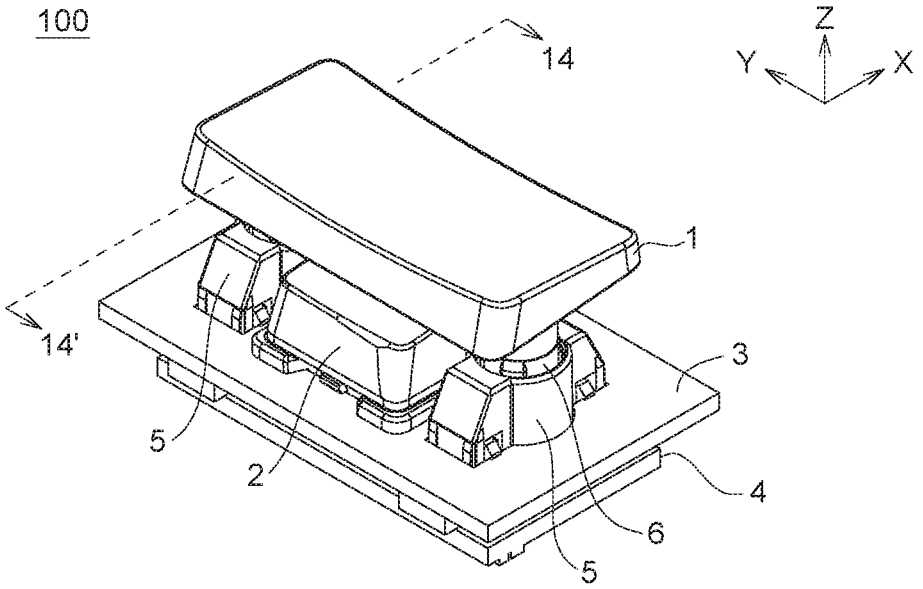
FIG. 1 is 3D assembly diagram of a key structure according to an embodiment of the present invention.

FIG. 1 is 3D assembly diagram of a key structure 100 according to an embodiment of the present invention. The key structure 100 can be used as the key board of an electronic device, such as a laptop computer or a desktop computer, to trigger a specific signal. As indicated in FIG. 1, the key structure 100 may include a keycap 1, a switch 2, a base plate 3, two fixing bases 5 and two movable members 6. The keycap 1 can be used in an MX key (such as the space key) or a 1X key (such as the letter keys).

Figure 2:
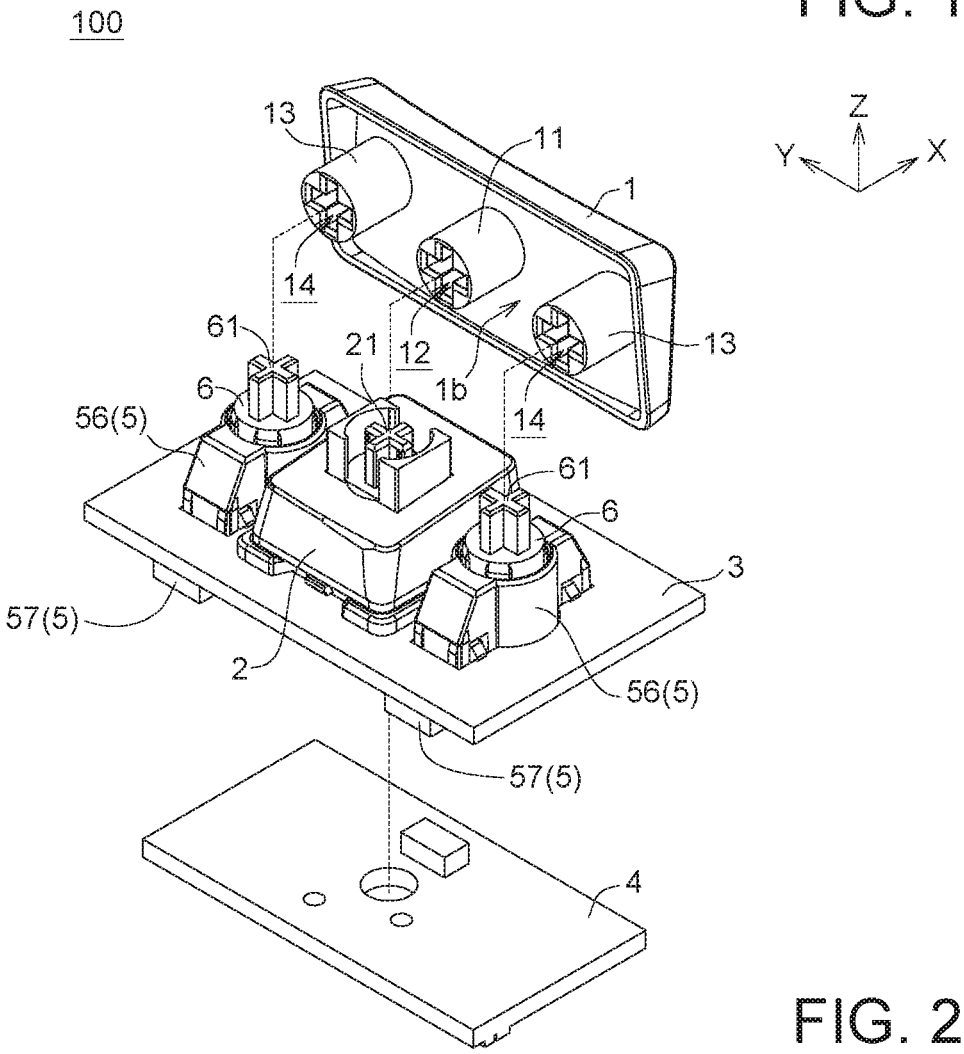
FIG. 2 is a partial explosion diagram of a key structure according to an embodiment of the present invention.

FIG. 2 is a partial explosion diagram of a key structure 100 according to an embodiment of the present invention. As indicated in FIG. 2, the switch 2 and the two fixing bases 5 are disposed on the base plate 3. The two movable members 6 are respectively disposed in the guiding channels 51 (illustrated in FIGS. 5A-5C) by passing through the fixing base 5. The two movable members 6 are movable in the guiding channels 51, such as moving up and down along the Z axis.

The keycap 1 may include a first column 11 and two second columns 13. The first column 11 and the two second columns 13 are disposed on the bottom surface 1*b* of the keycap 1 and extended downward from the bottom surface 1*b*. The first column 11 may have a switch slot 12, and each of the two second columns 13 may respectively have a movable member slot 14.

The top of the switch 2 may include a switch plunger 21 whose shape corresponds to that of the switch slot 12, such that the switch plunger 21 can be inserted into the switch slot 12 and be engaged therein.

The top of each of the two movable members 6 may include a movable member plunger 61 whose shape corresponds to that of the movable member slot 14, such that the movable member plunger 61 can be inserted into the movable member slot 14 and be engaged therein.

Through the switch 2 and the two movable members 6, the keycap 1 can move up and down between a pressed position and a non-pressed position along the Z axis. Specifically, when the user presses the keycap 1, the keycap 1 is guided by the two movable members 6 to move towards the −Z axis direction. Also, the switch 2 provides a restoring elasticity which restores the keycap 1 to the non-pressed position in the +Z axis direction.

As indicated in FIG. 2, the key structure 100 may further include a circuit board 4. The switch 2 may include two pins (not illustrated in FIG. 2). After the switch 2 is disposed on the base plate 3, the two pins can be inserted into the circuit board 4 and be further soldered on and electrically connected to the circuit board 4. When the keycap 1 moves to the pressed position from the non-pressed position, the switch 2 can generate a triggering signal to the circuit board 4 to turn on the circuit.

Figure 3:
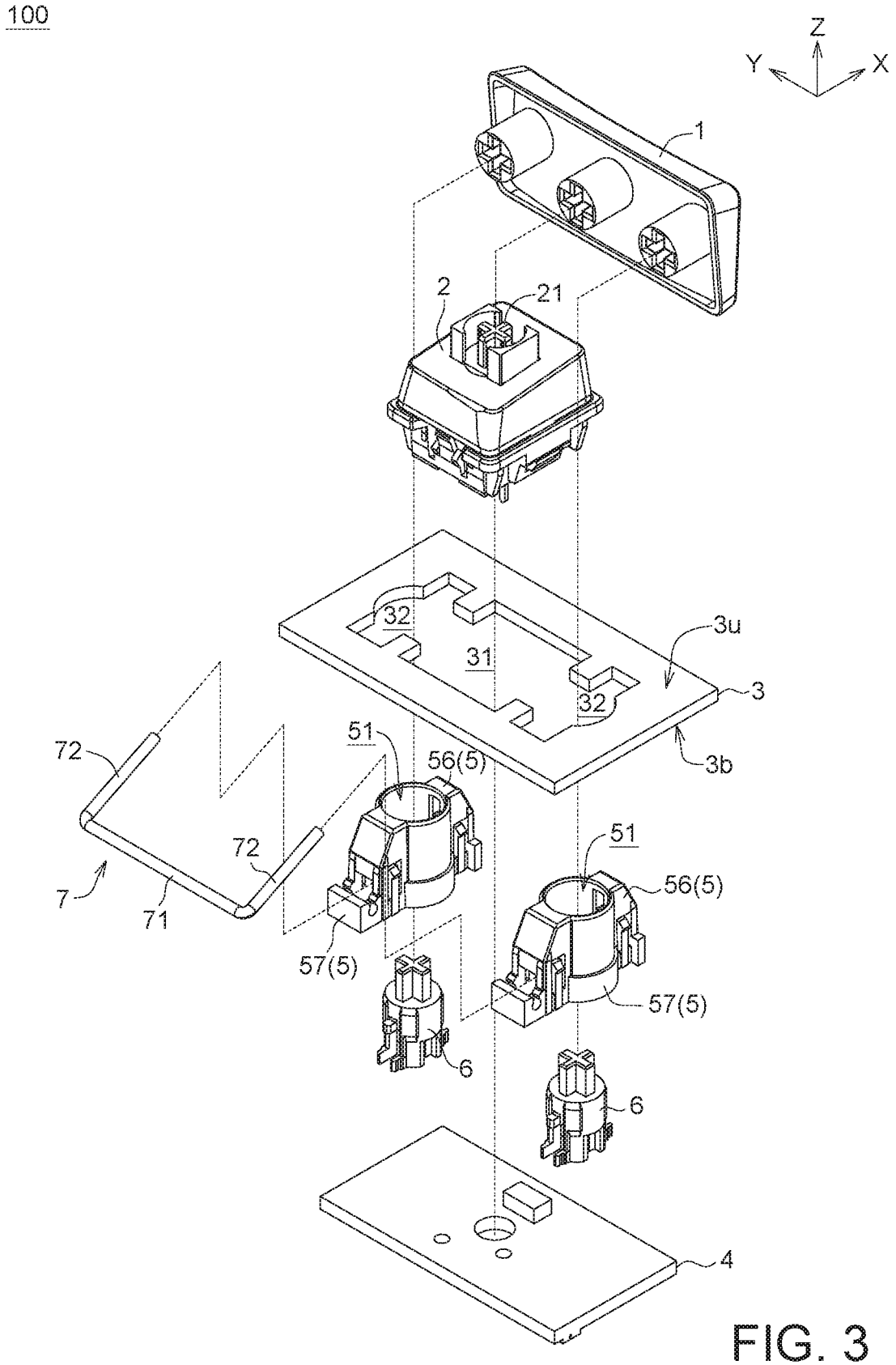
FIG. 3 is an explosion diagram of a key structure according to an embodiment of the present invention.

FIG. 3 is an explosion diagram of a key structure 100 according to an embodiment of the present invention. The base plate 3 includes an upper surface 3*u* and a bottom surface 3*b* opposite to the upper surface 3*u*. Additionally, the base plate 3 includes a first accommodation hole 31 which penetrates the upper surface 3*u* and the bottom surface 3*b* such that the switch 2 can be disposed on the base plate 3 by passing through the first accommodation hole 31. The base plate 3 further includes two second accommodation holes 32 facing two sides of the first accommodation hole 31. The two second accommodation holes 32 penetrates the upper surface 3*u* and the bottom surface 3*b*, such that the two fixing bases 5 can be disposed on the base plate 3 by passing through the two second accommodation holes 32.

As indicated in FIG. 3, the two fixing bases 5 are disposed on the base plate 3 by passing through the second accommodation hole 32 from the bottom surface 3*b* of the base plate 3 in the +Z axis direction. The fixing base 5 cannot be disposed on the base plate 3 from the upper surface 3*u* of the base plate 3. Specifically, when the fixing base 5 moves towards the −Z axis direction from the upper surface 3*u* of the base plate 3, the fixing base 5 may not be able to pass through the second accommodation hole 32 due to the size of the second accommodation hole 32 and/or the size of the fixing base 5

Furthermore, as indicated in FIG. 2 and FIG. 3, the fixing base 5 may include a first portion 56 and a second portion 57. When the fixing base 5 is disposed on the base plate 3, the fixing base 5 has a first portion 56 protruded from the upper surface 3*u* of the base plate 3 and a second portion 57 protruded from the bottom surface 3*b* of the base plate 3. Particularly, the projection area of the first portion 56 in a direction perpendicular to the upper surface 3*u* of the base plate 3 (that is, the Z axis direction) is not greater than the projection area of the second portion 57 in a direction perpendicular to the bottom surface 3*b* of the base plate 3 (that is, the Z axis direction). Thus, the fixing base 5 can only be disposed on the base plate 3 by passing through the second accommodation hole from the bottom surface 3*b* of the base plate 3 32 in the +Z axis direction, and cannot be disposed on the base plate 3 from the upper surface 3*u* of the base plate 3 in a downward or an inclined direction.

Each of the two fixing bases 5 has a guiding channel 51 penetrating the top and the bottom surface of the fixing base 5. The two movable members 6 can enter the guiding channels 51 from the bottom of the fixing base 5 in the +Z axis direction, and can move up and down in the guiding channels 51 along the Z axis. Moreover, when the keycap 1 is located at the non-pressed position, the movable members 6 can lean on the fixing base 5 in the guiding channels 51 to avoid the movable members 6 coming off the fixing base 5 in the +Z axis direction. Details of the structures of the fixing base 5 and the movable members 6 are disclosed below with accompanying drawings FIG. 4A, FIG. 4B, FIGS. 5A-5C.

Figure 4A:
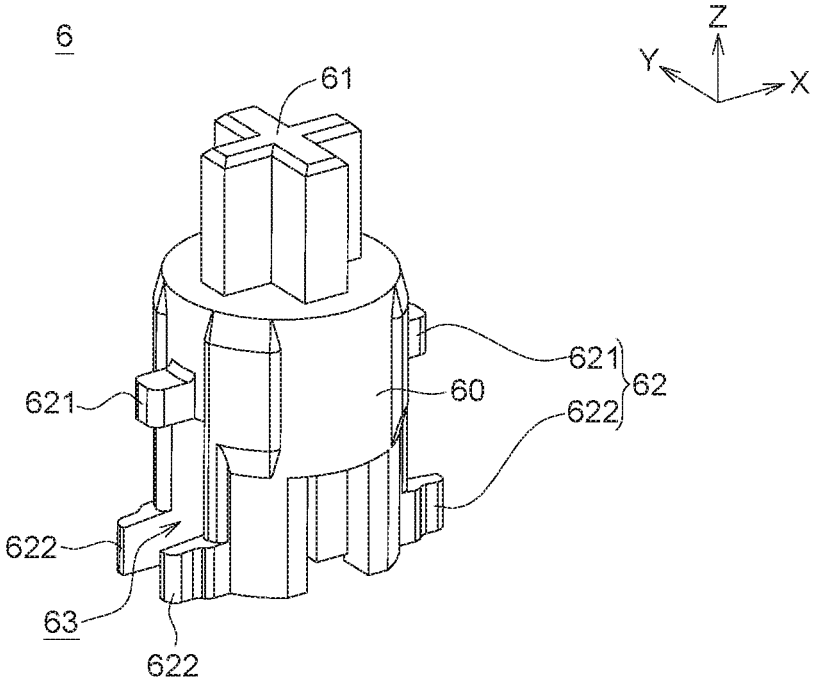
FIG. 4A and FIG. 4B are 3D diagrams of a movable member of a key structure viewed from different angles according to an embodiment of the present invention.
Figure 4B:
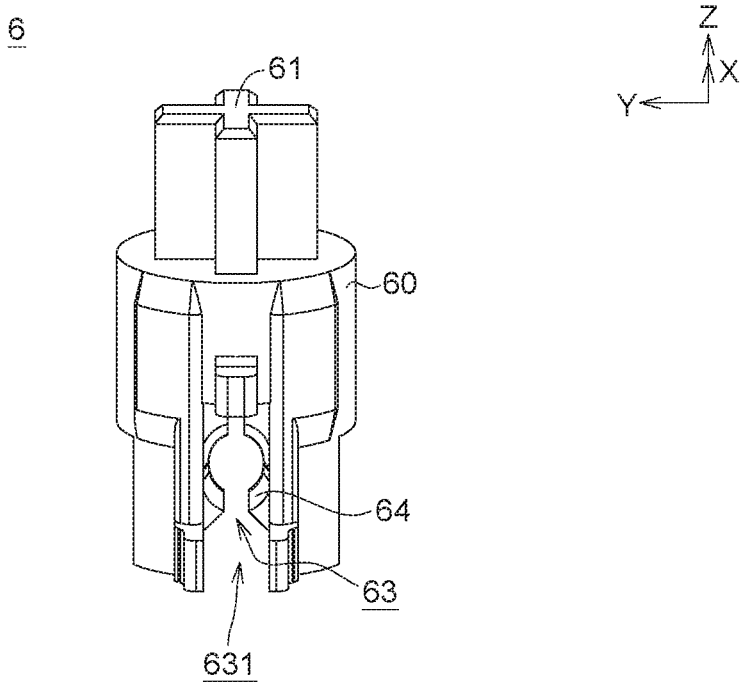
Figure 5A:
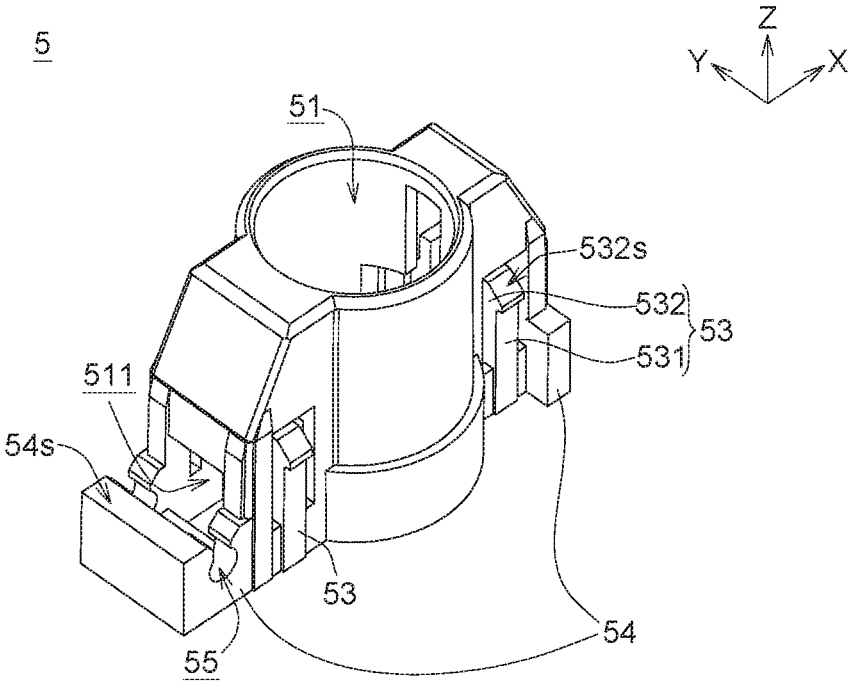
FIGS. 5A-5C are 3D diagrams of a fixing base of a key structure viewed from different angles according to an embodiment of the present invention.
Figure 5B:
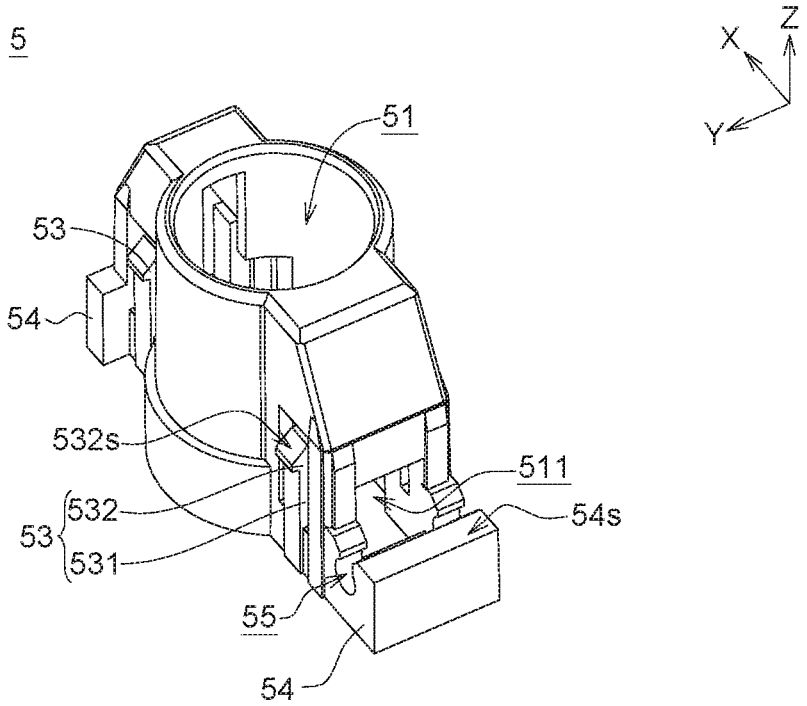
Figure 5C:
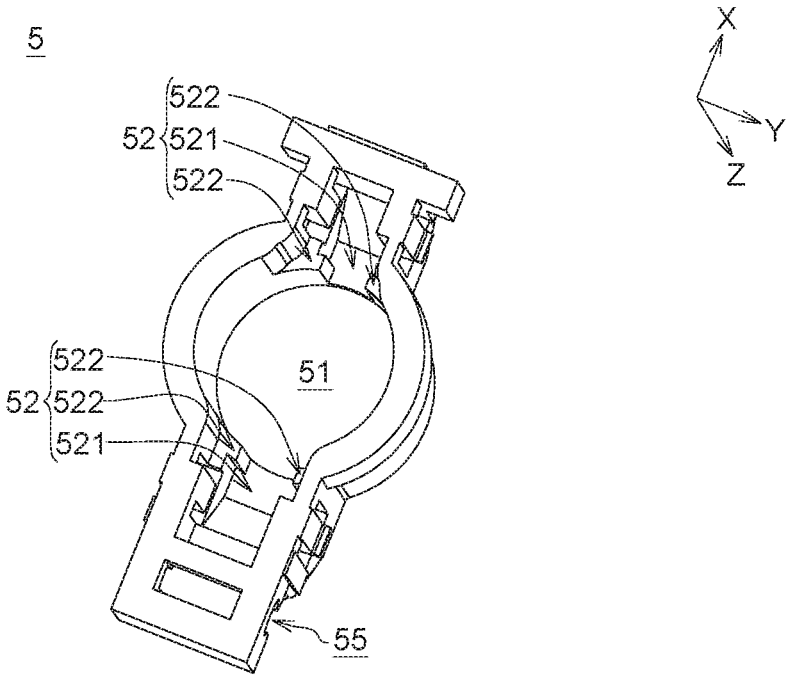

FIG. 4A and FIG. 4B are 3D diagrams of a movable members 6 of a key structure 100 viewed from different angles according to an embodiment of the present invention. FIGS. 5A~5C are 3D diagrams of a fixing base 5 of a key structure 100 viewed from different angles according to an embodiment of the present invention.

As indicated in FIG. 4A and FIG. 4B, the movable members 6 may include a body 60. The body may have a cylindrical shape. Through such design, the processing accuracy of the mold can be increased, and the manufacturing can be made faster and more convenient.

As indicated in FIG. 4A, the movable member plunger 61 can be disposed on the upper surface of the body 60. Besides, the movable members 6 may further include multiple protrusions 62 protruded from the side surface of the body 60 in a radial direction. Furthermore, the protrusions 62 may further include multiple flanks 621 and multiple side ribs 622. The flanks 621 can be disposed in a symmetric manner, and the side ribs 622 can also be disposed in a symmetric manner. The protrusions 62 may have a certain thickness (the length along the Z axis) to provide a certain level of stiffness.

As indicated in FIG. 5C, the fixing base 5 may include a plurality of first stopping surfaces 52 disposed in the guiding channels 51 and facing the bottom of the fixing base 5, that is, the −Z axis direction. When the keycap 1 is located at the non-pressed position, the protrusions 62 of the movable members 6 lean on the first stopping surfaces 52 of the fixing base 5 to avoid the movable members 6 coming off the fixing base 5 in the +Z axis direction.

To put it in greater details, the first stopping surfaces 52 may include multiple flanks stopping surfaces 521 and multiple side ribs stopping surfaces 522. The flanks stopping surfaces 521 correspond to the flanks 621, and the side ribs stopping surfaces 522 correspond to the side ribs 622. When the keycap 1 is located at the non-pressed position, the flanks 621 lean on the flanks stopping surfaces 521, and the side ribs 622 lean on the side ribs stopping surfaces 522. The flanks 621 and the side ribs 622 both have a certain level of stiffness, and therefore can provide a reliable engaging and leaning effect between the movable members 6 and the fixing base 5. Thus, when the user needs to unplug the keycap 1 for maintenance or adjustment purpose, the flanks 621 and the side ribs 622 can avoid the keycap 1 being deformed due to the applied force being too large. The flanks 621 and the side ribs 622 can lean on the flanks stopping surfaces 521 and the side ribs stopping surfaces 522 to avoid the movable members 6 coming off the fixing base 5 in the +Z axis direction.

Moreover, when the movable members 6 move up and down in the guiding channels 51 of the fixing base 5, the flanks 621 and the side ribs 622 can also provide a guiding and positioning effect. Thus, the movable members 6 can smoothly and steadily move up and down in the guiding channels 51, and the reciprocating motion of the keycap 1 along the Z axis will not be affected when the movable members 6 rotate and loose stability.

As indicated in FIG. 5A and FIG. 5B, the fixing base 5 may include multiple stopping portions 54. Refer to FIG. 3. When the fixing base 5 is disposed on the base plate 3, the stopping portions 54 can stably lean on the bottom surface 3*b* of the base plate 3, such that the fixing base 5 cannot move forward in the +Z axis direction. The stopping portions 54 further have a certain level of stiffness, such that the fixing base 5 can only pass through the second accommodation hole 32 from the bottom surface 3*b* of the base plate 3 in the +Z axis direction and cannot pass through the second accommodation hole 32 from the upper surface 3*u* of the base plate 3.

As indicated in FIG. 5A and FIG. 5B, the fixing base 5 may further include multiple hooking portions 53. In an embodiment, the fixing base 5 may include four hooking portions 53 respectively disposed on two opposite sides of the fixing base 5, but the present invention is not limited thereto. Refer to FIG. 2 and FIG. 3. The projection area of the first portion 56 other than the hooking portions 53 in a direction perpendicular to the upper surface 3*u* of the base plate 3 is located within the second accommodation hole 32. In other words, the projection area of the first portion 56 other than the hooking portions 53 in the Z axis direction is not greater than the area of the second accommodation hole 32, therefore the fixing base 5 passes through the second accommodation hole 32 from the bottom surface 3*b* of the base plate 3 in the +Z axis direction. When the fixing base 5 is disposed on the base plate 3, the hooking portions 53 are coupled to the upper surface 3*u* of the base plate 3, such that the fixing base 5 cannot come off the base plate 3 in the −Z axis direction unless the bucking state of the hooking portions 53 is released.

Specifically, hooking portions 53 may include a cantilever 531 and a hook 532 connected to the cantilever 531. The cantilever 531 provides elasticity to the hooking portions 53. During the process in which the fixing base 5 passes through the second accommodation hole 32 from the bottom surface 3*b* of the base plate 3 in the +Z axis direction, the edge of the second accommodation hole 32 pushes the hook 532 and makes the cantilever 531 become deformed. Thus, the hook 532 can be hooked onto the upper surface 3*u* of the base plate 3 by passing through the second accommodation hole 32. Furthermore, the hook 532 may further include a bevel 532*s* corresponding to the edge of the second accommodation hole 32. Thus, during the process in which the fixing base 5 passes through the second accommodation hole 32 from the bottom surface 3*b* of the base plate 3 in the +Z axis direction, the edge of the second accommodation hole 32 can push the bevel 532*s* and make the cantilever 531 become deformed.

Through the disposition of the stopping portions 54 and the hooking portions 53, the fixing base 5 can be firmly disposed on the base plate 3. When the fixing base 5 is disposed on the base plate 3, the hooking portions 53 are coupled to the upper surface 3*u* of the base plate 3, and the stopping portions 54 lean on the bottom surface 3*b* of the base plate 3 and make the fixing base 5 be located within the second accommodation hole 32. Meanwhile, the stopping portions 54 firmly lean on the bottom surface 3*b* of the base plate 3 through a second stopping surface 54*s*.

As indicated in FIG. 3, the key structure 100 may further include a balance rod 7. The balance rod 7, which can be realized by a U-shaped rod, includes a pivot rod 71, and two guide rods 72 connected to the pivot rod 71. Through the disposition of the balance rod 7, the two movable members 6 can simultaneously move up and down in the guiding channels 51 and the keycap 1 will not tilt to an angle.

As indicated in FIG. 4A and FIG. 4B, the movable members 6 may further include an engaging portion 64 and have an accommodation groove 63, and the bottom of the movable members 6 may further have an opening portion 631 interconnected with the accommodation groove 63. The engaging portion 64 is disposed in the accommodation groove 63, and the guide rods 72 of the balance rod 7 can be disposed in the accommodation groove 63 through the opening portion 631 and be engaged with the engaging portion 64.

As indicated in FIG. 5A and FIG. 5B, the fixing base 5 may further have a pivot hole 55 and a notch portion 511. The notch portion 511 and the guiding channels 51 are interconnected with the pivot hole 55. The pivot hole 55 allows the pivot rod 71 of the balance rod 7 to be pivotally inserted into the pivot hole 55 on one side of the two fixing bases 5. In an embodiment, the pivot hole 55 can be indented into the second stopping surface 54*s* of the stopping portions 54, but the present invention is not limited thereto.

In an embodiment, pivot hole 55 may have a curved surface whose shape corresponds to that of the pivot rod 71. Thus, when the pivot rod 71 rotates in the pivot hole 55, the balance rod 7 will not wobble and the wobbling angles of the guide rods 72 on the two sides of the balance rod 7 will not be inconsistent.

FIG. 6 to FIG. 13 are 3D schematic diagrams of an assembly process of a key structure 100 according to an embodiment of the present invention, wherein the steps of the assembly process are illustrated using various cross-sectional views, side views, and other view angles.

Figure 6:
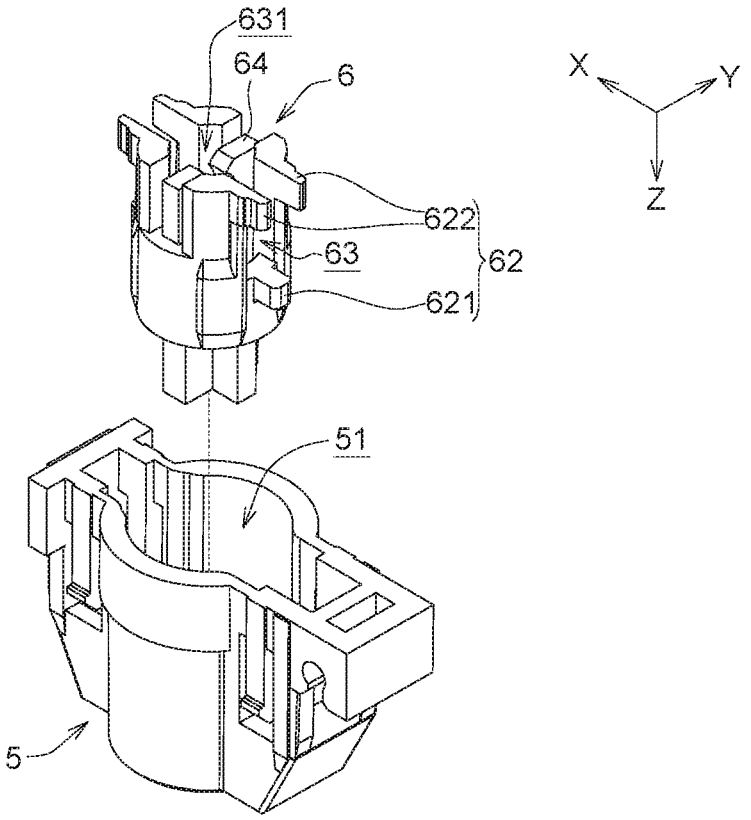
FIG. 6 to FIG. 13 are 3D schematic diagrams of an assembly process of a key structure according to an embodiment of the present invention, wherein the steps of the assembly process is illustrated using various cross-sectional views, side views, and other view angles.

Refer to FIG. 6. Firstly, the movable members 6 are placed in the guiding channels 51 from the bottom of the fixing base 5. In the present step, the movable members 6 can be placed in the guiding channels 51 from the bottom of the fixing base 5 in an inverted manner, such that the protrusions 62 of the movable members 6 can lean on the first stopping surfaces 52 of the fixing base 5 (illustrated in FIG. 5C).

For the convenience of explanation, FIG. 7, FIG. 8A, FIG. 8B, FIG. 8C and FIG. 9 are not illustrated in an inverted manner like FIG. 6. It should be understood that the steps illustrated in FIG. 7, FIG. 8A, FIG. 8B, FIG. 8C and FIG. 9 can be performed in an inverted manner like the corresponding steps illustrated in FIG. 6.

Figure 7:
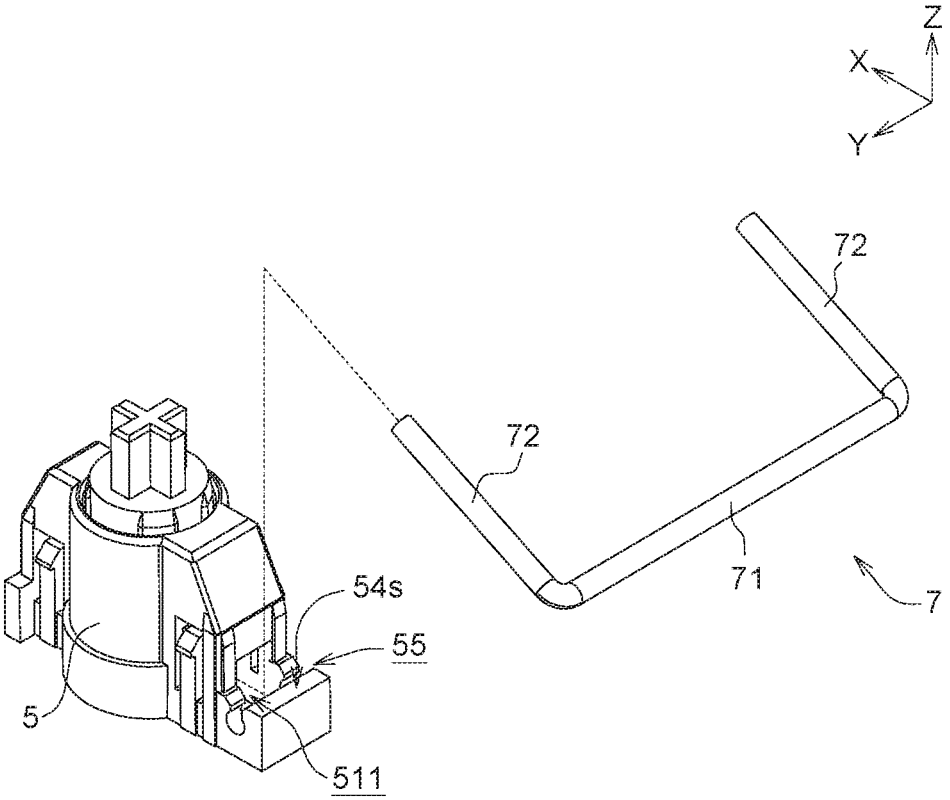

As indicated in FIG. 7, a guide rod 72 of the balance rod 7 can be placed from the notch portion 511 of the fixing base 5.

Figure 8A:
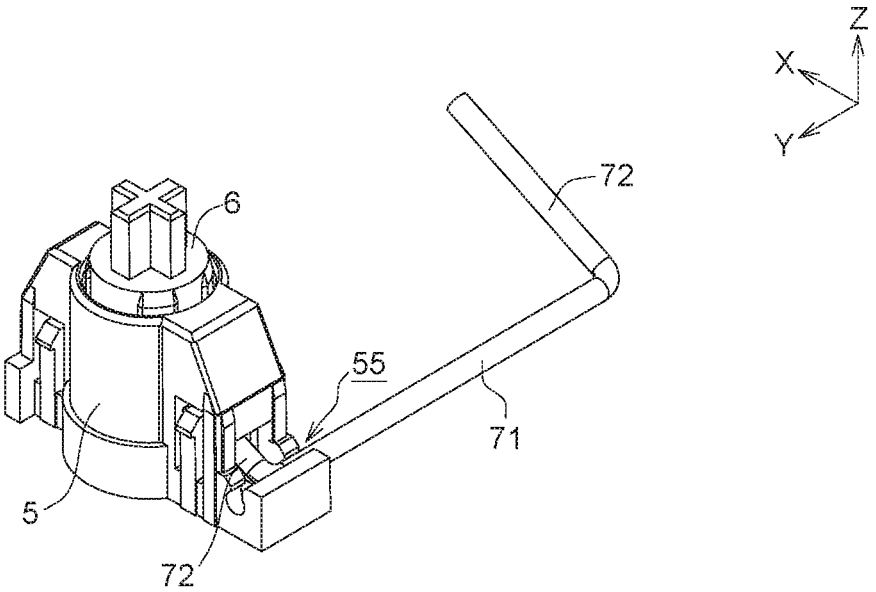
Figure 8B:
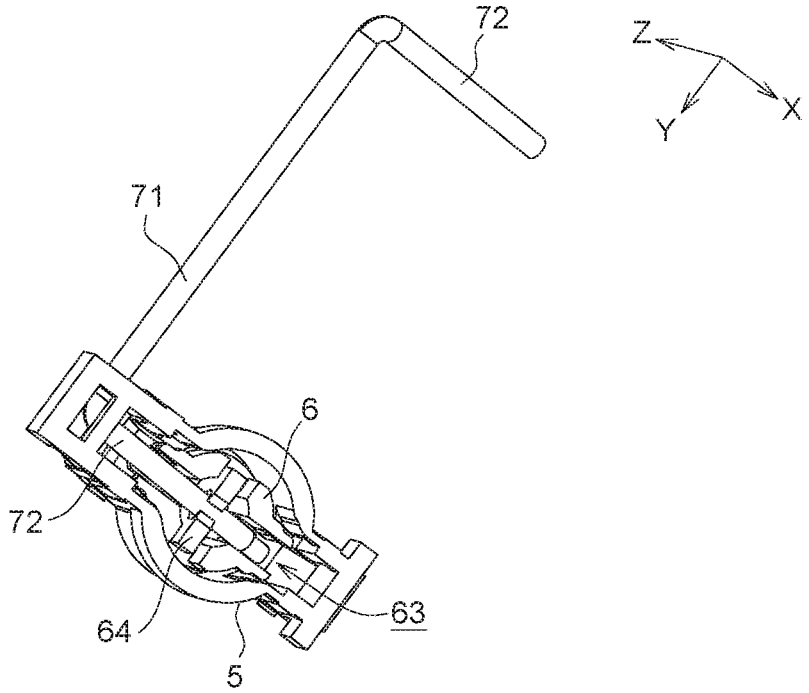
Figure 8C:
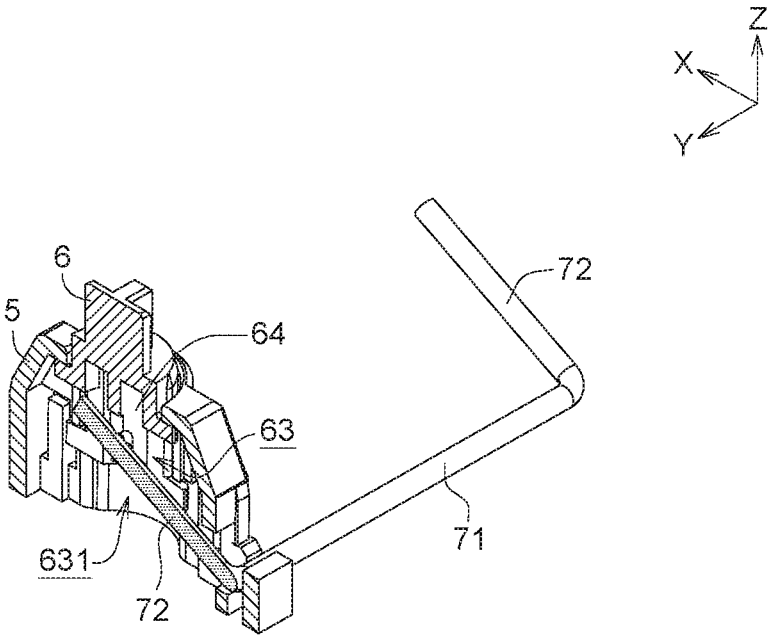

As indicated in FIG. 8A, FIG. 8B and FIG. 8C, after a guide rod 72 is placed in the accommodation groove 63 through the opening portion 631 of one movable member 6 and is engaged with the engaging portion 64, the pivot rod 71 of the balance rod 7 is pivotally inserted into the pivot hole 55 of the fixing base 5.

Figure 9:
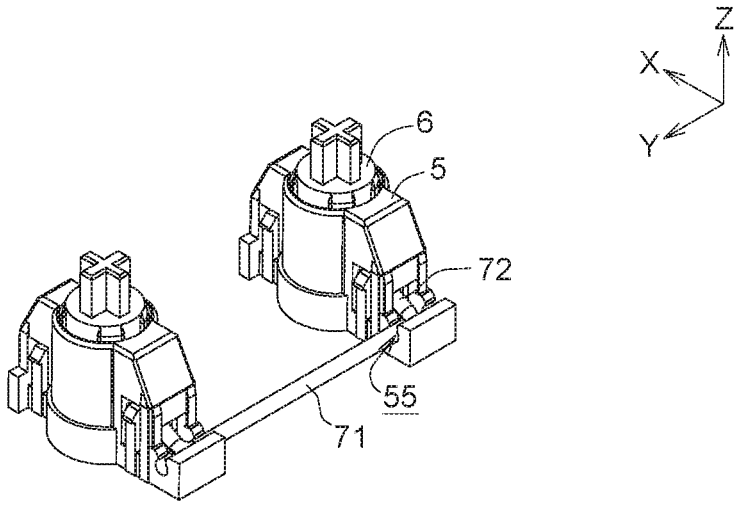

Then, another guide rod 72 of the balance rod 7 is engaged with the engaging portion 64 of another movable member 6 in a method illustrated in the FIG. 7, FIG. 8A, FIG. 8B and FIG. 8C, and the pivot rod 71 of the balance rod 7 is pivotally inserted into another pivot hole 55 of the fixing base 5 as indicated in FIG. 9.

In an embodiment, after the two guide rods 72 are engaged with the engaging portion 64 of the two movable members 6, the pivot rod 71 of the balance rod 7 is pivotally inserted into the pivot hole 55 on one side of the two fixing bases 5.

Figure 10:
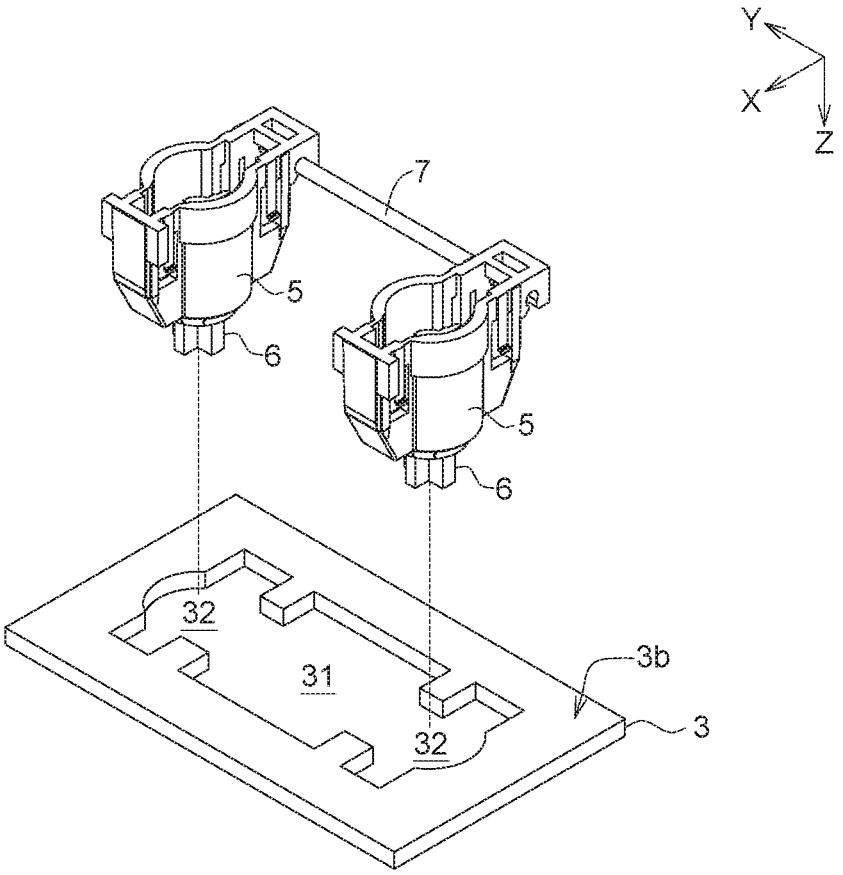

Refer to FIG. 10, the two fixing bases 5 are assembled to the second accommodation hole 32 from the bottom surface 3*b* of the base plate 3 in the +Z axis direction.

Figure 11A:
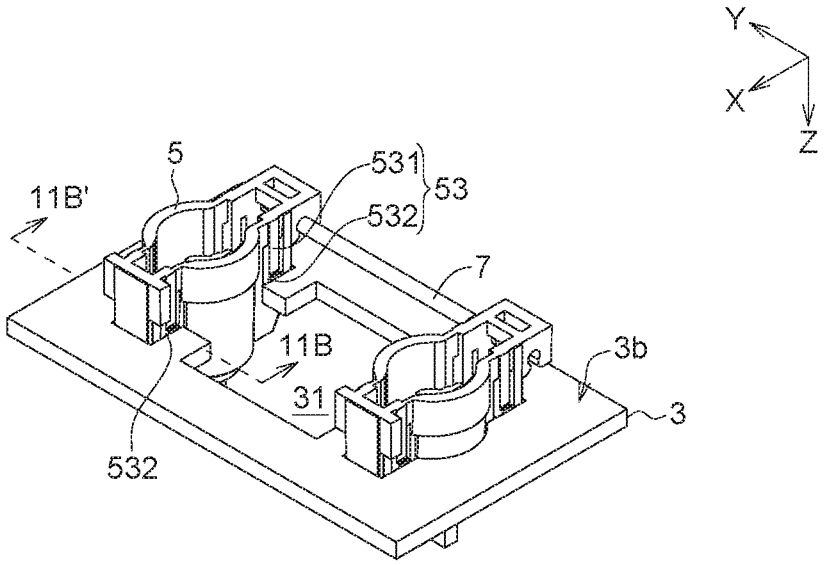
Figure 11B:
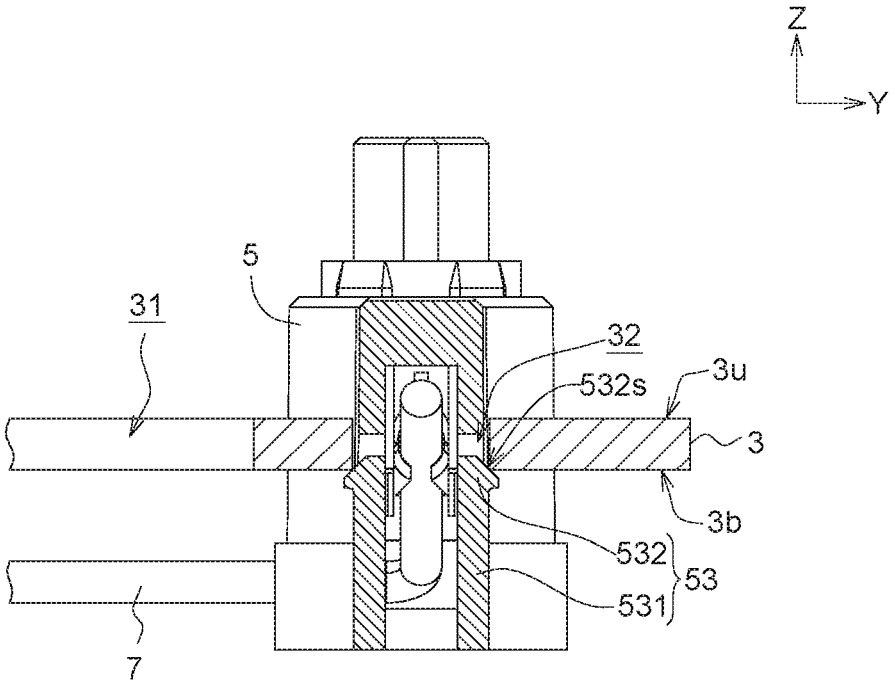

Refer to FIG. 11A and FIG. 11B. FIG. 11B is a cross-sectional view along the cross-sectional line 11B-11B' of FIG. 11A. During the process in which the fixing base 5 passes through the second accommodation hole 32 from the bottom surface 3*b* of the base plate 3, the edge of the second accommodation hole 32 pushes the bevel 532*s* of the hook 532 of the hooking portions 53 and makes the cantilever 531 of the hooking portions 53 become deformed.

Figure 12A:
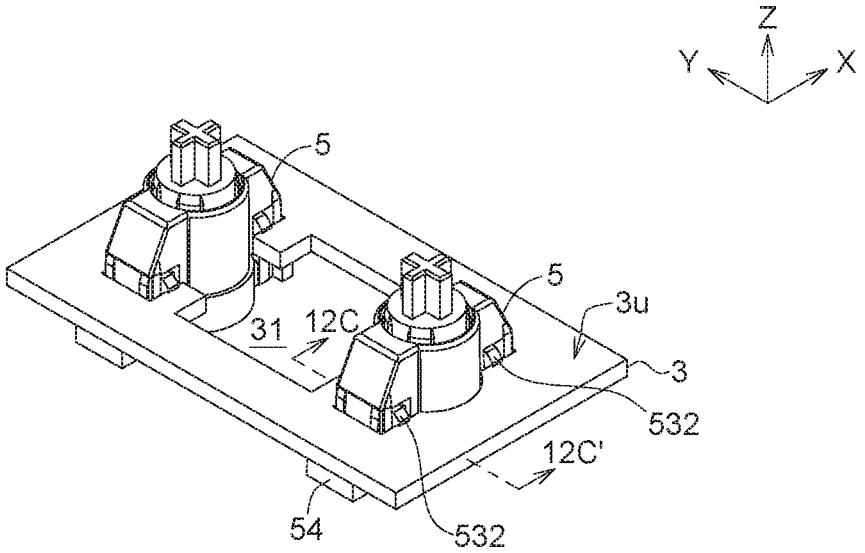
Figure 12B:
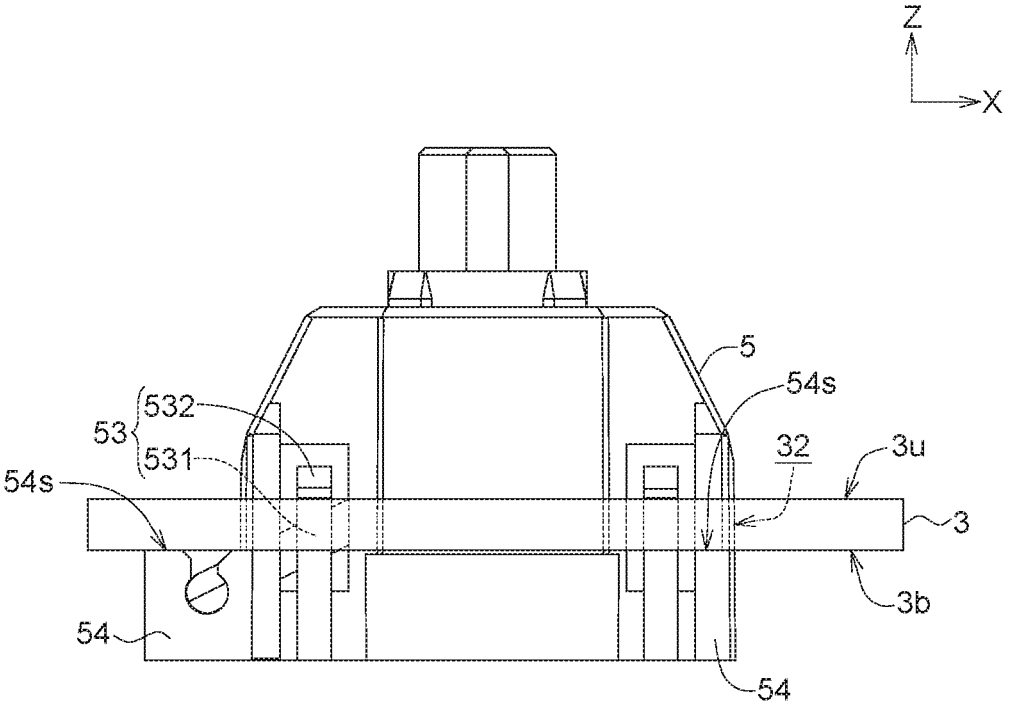
Figure 12C:
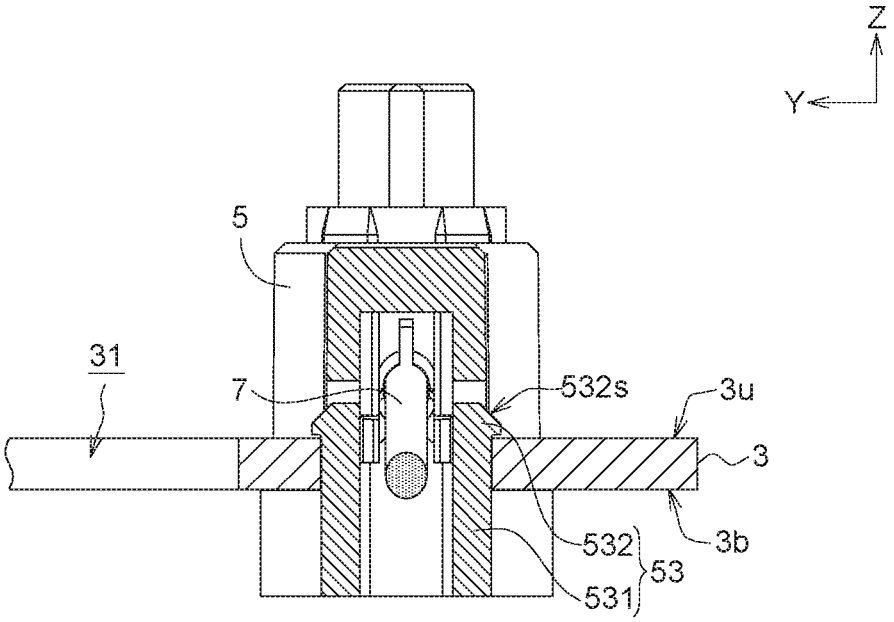

Refer to FIG. 12A, FIG. 12B and FIG. 12C. FIG. 12B is a side view along the +Y axis direction of FIG. 12A. FIG. 12C is a cross-sectional view along the cross-sectional line 12C-12C' of FIG. 12A. After the cantilever 531 of FIG. 11A and FIG. 11B is deformed, the hook 532 is hooked onto the upper surface 3*u* of the base plate 3 by passing through the second accommodation hole 32. Moreover, the stopping portions 54 of the fixing base 5 lean on the bottom surface 3*b* of the base plate 3, such that the stopping portions 54 can be stably coupled to the bottom surface 3*b* of the base plate 3 through the second stopping surface 54*s*. Thus, the fixing base 5 can be positioned in the second accommodation hole 32.

In the steps of FIG. 10, FIG. 11A and FIG. 12A, the balance rod 7 together with the two fixing bases 5 are assembled to the second accommodation hole 32 from the bottom surface 3*b* of the base plate 3 in the +Z axis direction instead of being assembled to the second accommodation hole 32 from the upper surface 3*u* of the base plate 3 in the −Z axis direction, the base plate 3 does not need to be large and long hole for the balance rod 7 to pass though. The size and shape of the second accommodation hole 32 only needs to match that of the fixing base. Thus, the structure under the base plate is less likely to be seen. Moreover, when the keycap 1 has a larger length, for example, the keycap is used in an MX key, the first accommodation hole 31 can be separated from the two second accommodation holes 32 respectively. Under such circumstance, the first accommodation hole 31 and the two second accommodation holes 32 are not interconnected, so the structure under the base plate 3 is even less likely to be seen.

Figure 13:
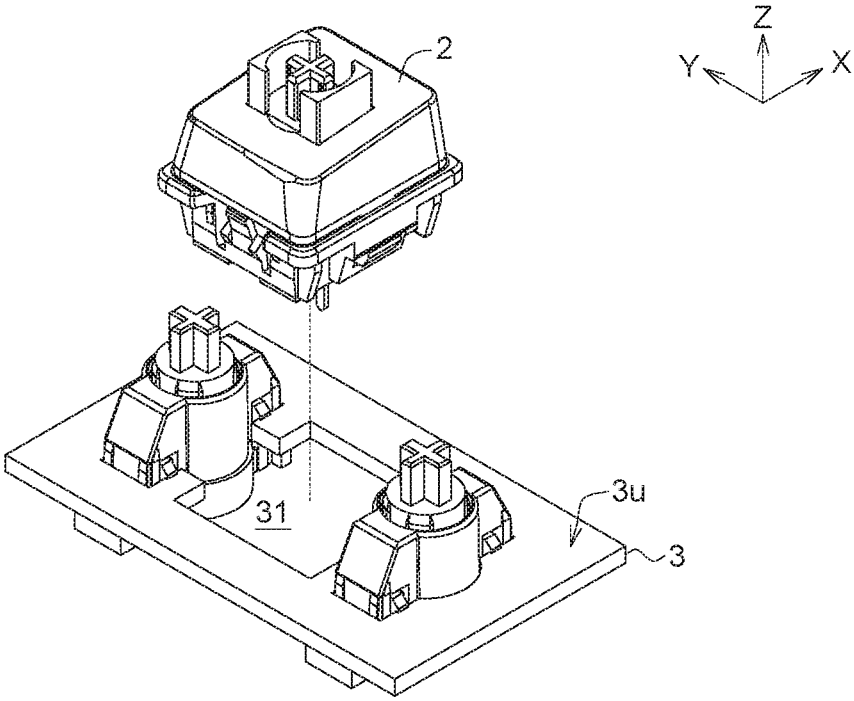

Refer to FIG. 13, the switch 2 passes by passing through the first accommodation hole 31 to be disposed on the base plate 3. In the present step, the switch 2 is assembled to the first accommodation hole 31 in the −Z axis direction from the upper surface 3*u* of the base plate 3.

Lastly, as indicated in FIG. 2, the switch 2 and the circuit board 4 are electrically connected, and the keycap 1 is disposed on the switch 2 and the two movable members 6.

Figure 14:
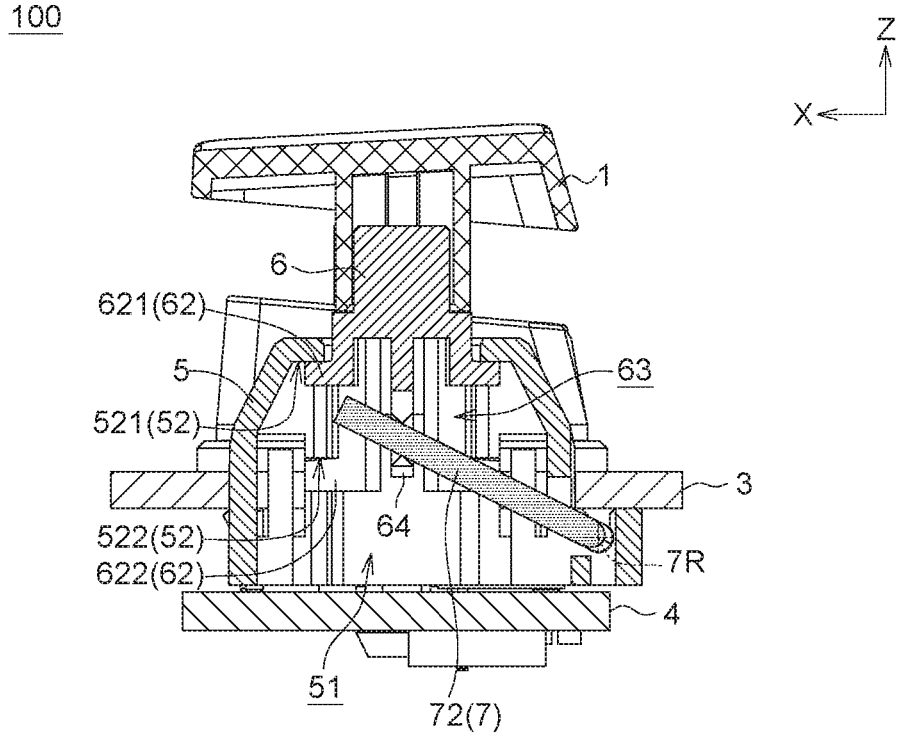
FIG. 14 is a cross-sectional view of a key structure when the keycap is located at a non-pressed position according to an embodiment of the present invention.
Figure 15:
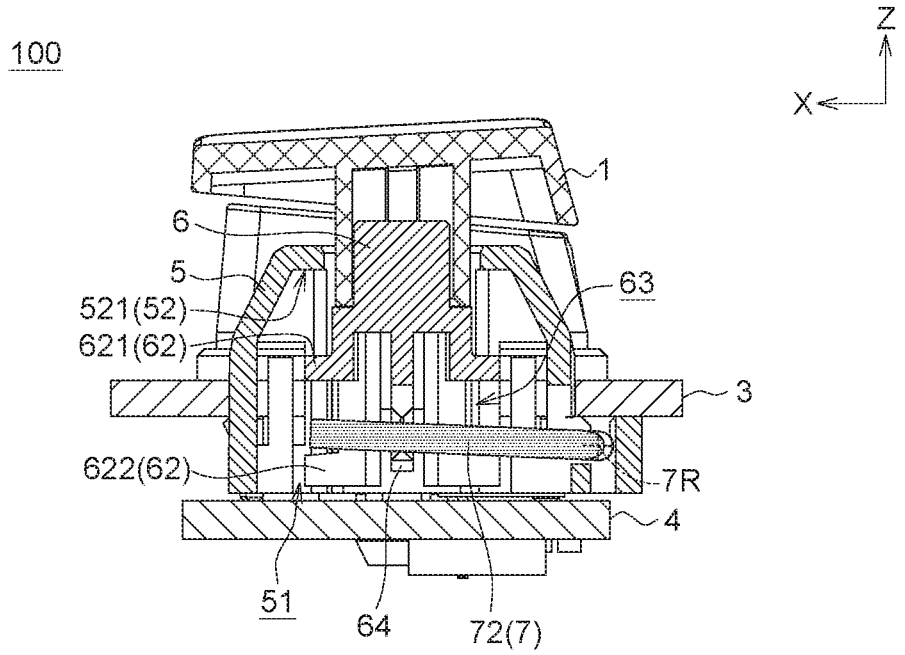
FIG. 15 is a cross-sectional view of a key structure when the keycap is located at a pressed position according to an embodiment of the present invention.

FIG. 14 is a cross-sectional view of a key structure 100 when the keycap 1 is located at a non-pressed position according to an embodiment of the present invention. FIG. 15 is a cross-sectional view of a key structure 100 when the keycap 1 is located at a pressed position according to an embodiment of the present invention.

Refer to FIG. 14, when the keycap 1 is located at the non-pressed position, the flanks 621 leans on the flanks stopping surfaces 521, the side ribs 622 leans on the side ribs stopping surfaces 522, and the flanks 621 and the side ribs 622 can provide a reliable engaging and leaning effect between the movable members 6 and the fixing base 5 to avoid the movable members 6 coming off the fixing base 5 in the +Z axis direction.

Refer to FIG. 15, when the user presses the keycap 1, the movable members 6 are displaced downwards along with the keycap 1, such that the two guide rods 72 engaged through the engaging portion 64 can swing around the rotation axis 7R of the pivot rod 71, the two guide rods 72 can swing to the same swinging angle, and the two movable members 6 are displaced downwards by the same distance. Thus, the keycap 1 will not tilt to any side.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A key structure comprising:

a base plate comprising an upper surface and a bottom surface and having a first accommodation hole and two second accommodation holes penetrating through the upper surface and the bottom surface;

a switch disposed on the base plate and passing through the first accommodation hole;

two fixing bases respectively disposed on the base plate and passing through the two second accommodation holes, wherein each of the two fixing bases has a guiding channel and comprises a plurality of first stopping surfaces facing the bottom of each of the two fixing bases;

two movable members each disposed in one guiding channel of the two fixing bases, wherein each of the two movable members comprises a body and a plurality of protrusions radially protruded from a side surface of the body; and a keycap disposed on the switch and two movable members;

wherein, each of the two fixing bases comprises a first portion protruded from the upper surface and a second portion protruded from the bottom surface, and a projection area of the first portion in a direction perpendicular to the upper surface is not greater than a projection area of the second portion in a direction perpendicular to the bottom surface, and when the keycap is located at a non-pressed position, the protrusions lean on the first stopping surfaces.

2. The key structure according to claim 1, wherein each of the two fixing bases comprises a plurality of hooking portions; when the two fixing bases are disposed on the base plate, the hooking portions are coupled to the upper surface.

3. The key structure according to claim 2, wherein each of the hooking portions comprises a cantilever and a hook; when the two fixing bases are disposed on the base plate, the cantilever passes through a corresponding second accommodation hole, and the hook is hooked onto the upper surface.

4. The key structure according to claim 3, wherein the hook comprises a bevel corresponding to an edge of the corresponding second accommodation hole.

5. The key structure according to claim 2, wherein a projection area of the first portion other than the hooking portions in the direction perpendicular to the upper surface is located within a corresponding second accommodation hole.

6. The key structure according to claim 1, wherein each of the two fixing bases comprises a plurality of stopping portions; when the two fixing bases are disposed on the base plate, the stopping portions lean on the bottom surface.

7. The key structure according to claim 6, further comprising:

a balance rod comprising a pivot rod and two guide rods connected to two ends of the pivot rod;

wherein each of the two fixing bases further has a pivot hole, each of the two movable members comprises an engaging portion and has an accommodation groove, the engaging portion is disposed in the accommodation groove, the pivot rod is inserted into two pivot holes of the two fixing bases, and the two guide rods respectively pass through two accommodation grooves of the two movable members, and are engaged with two engaging portions of the two movable members.

8. The key structure according to claim 7, wherein each of the stopping portions comprises a second stopping surface into which the pivot hole is indented.

9. The key structure according to claim 7, wherein the pivot hole has a curved surface corresponding to a shape of the pivot rod.

10. An assembly method of a key structure comprising:

providing two fixing bases and two movable members, wherein each of the two fixing bases has a guiding channel and comprises a plurality of first stopping surfaces facing the bottom of each of the two fixing bases, and each of the two movable members comprises a body and a plurality of protrusions radially protruded from a side surface of the body;

placing the two movable members respectively in two guiding channels of the two fixing bases from the bottom of the two fixing bases, such that the protrusions lean on the first stopping surfaces;

providing a base plate comprising an upper surface and a bottom surface and having a first accommodation hole and two second accommodation holes penetrating through the upper surface and the bottom surface;

respectively disposing the two fixing bases on the base plate from the bottom surface through the two second accommodation holes;

providing a switch disposed on the base plate and passing through the first accommodation hole; and providing a keycap disposed on the switch and the two movable members.

11. The assembly method according to claim 10, wherein in the step of respectively disposing the two fixing bases on the base plate from the bottom surface through the two second accommodation holes, each of the two fixing bases is coupled to the upper surface by a plurality of hooking portions.

12. The assembly method according to claim 11, wherein each of the hooking portions comprises a cantilever and a hook comprising a bevel, and the step of respectively disposing the two fixing bases on the base plate from the bottom surface through the two second accommodation holes comprises:

providing the hook and the cantilever passing through the second accommodation hole from the bottom surface, wherein an edge of the second accommodation hole pushes the bevel and makes the cantilever become deformed; and hooking the hook onto the upper surface.

13. The assembly method according to claim 10, wherein each of the two fixing bases further has a pivot hole, each of the two movable members comprises an engaging portion and has an accommodation groove in which the engaging portion is disposed, and the bottom of each of the two movable members has an opening portion interconnected with the accommodation groove, and the assembly method further comprises:

providing a balance rod comprising a pivot rod and two guide rods connected to two ends of the pivot rod; and respectively engaging the two guide rods in the two engaging portions through two accommodation grooves of the two movable members from two opening portions of the two movable members, and inserting the pivot rod into the two pivot holes.

14. The assembly method according to claim 13, wherein the step of respectively engaging the two guide rods in the two engaging portions through the two accommodation grooves from the two opening portions and inserting the pivot rod into the two pivot holes is performed prior to the step of respectively disposing the two fixing bases on the base plate from the bottom surface through the two second accommodation holes.

* * * * *